US005807139A

United States Patent [19]

Volansky et al.

[11] Patent Number: 5,807,139

[45] Date of Patent: Sep. 15, 1998

[54] SURFACE MOUNT MULTIMEDIA OUTLET

[75] Inventors: Edward J. Volansky, Naugatuck; John A. Siemon, Woodbury; Randy J. Below, Cheshire, all of Conn.

[73] Assignee: The Siemon Company, Watertown, Conn.

[21] Appl. No.: 334,781

[22] Filed: Nov. 4, 1994

[51] Int. Cl.[6] ..... H01R 13/73

[52] U.S. Cl. ..... 439/638; 439/491; 439/639

[58] Field of Search ..... 439/140–142, 439/709–717, 452, 488–491, 638–654

[56] References Cited

U.S. PATENT DOCUMENTS

| | | | |
|---|---|---|---|
| 4,303,296 | 12/1981 | Spaulding | 439/638 |
| 4,775,802 | 10/1988 | Dods | 439/652 |
| 5,011,419 | 4/1991 | Maan et al. | 439/140 |
| 5,030,129 | 7/1991 | Koch | 439/140 |
| 5,143,868 | 9/1992 | Caveney et al. | 439/540.1 |
| 5,295,869 | 3/1994 | Siemon et al. | 439/620 |
| 5,362,254 | 11/1994 | Siemon et al. | 439/142 |

OTHER PUBLICATIONS

AMP Incorporated; Surface Mount Outlet.

Catalog; Panduit MOD–COM Boxes—Component Section.

Siecor; Siecor Universal Transport System Information Outlet (UTS–10).

Suttle Apparatus; Suttle Specifications.

Ortronics; Multimedia Outlet.

MOD–TAP; Multi Media Interface Installation Instructions; Oct. 1993.

Hubbel Premise Wiring, Inc.; Voice and Data Design Flexibility.

Siecor; Installation Procedure for the Siecor® UTS–Information Outlet; Oct. 1989.

Cabling Installation & Maintenance; Aug. 12, 1994; Modular Multimedia Outlets.

Systimax PDS Components Guide; Dec. 1990; 40A1 Multimedia Information Outlet.

The Wiremold Company; 2949FO—Fiber Optic Kit Installation Instructions.

*Primary Examiner*—J. J. Swann

*Attorney, Agent, or Firm*—Fishman, Dionne, Cantor & Colburn

[57] ABSTRACT

A surface mount multimedia connector housing is disclosed. The housing is both a functional and aesthetically pleasing arrangement which is beneficial for visible placement. The housing is configured in alternate embodiments of two or six ports wherein anywhere from one through six ports may be operable. More specifically, one or two ports may be operable in the two port housing and one through six ports may operate in the six port housing, as desired. Identification of each port is provided for both, by the inclusion of colored tabs with Icons and by write-on labels oriented on the cover of the housing. The unit provides storage for excess cable, and segmented knockouts for cable/raceway entry.

38 Claims, 13 Drawing Sheets

SURFACE MOUNT MULTIMEDIA OUTLET

BACKGROUND OF THE INVENTION

1. Field of the Invention

The invention relates generally to the field of telecommunications outlets for connecting devices using various cable media and connectors. More specifically, the invention provides an aesthetically pleasing and dimensionally minimal enclosure having a number of receptacles for multimedia connections.

2. Prior Art

Many telecommunications outlets are of course available on the commercial telecommunications supply market. Outlets range in size and shape in accordance with their particular intended application. Typically, however, outlets are larger than is desired in many cases. This is true especially where the application is for a one or two port outlet mounted within the workspace of a user. In this situation the user would clearly appreciate the smallest possible outlet.

Within the design constraints of creating a smaller, less obtrusive connector many outlets have sacrificed cable opening capability, strain relief or category five compliance.

Where the outlet contemplated is larger and configured to support a multimedia network, drawbacks of presently existing outlets include those listed above and additionally include the failure to provide cable management. Indeed some products do provide cable management, however, most of these do not provide industry standard minimum bend radii for copper or fiber cables.

SUMMARY OF THE INVENTION

The above-discussed and other drawbacks and deficiencies of the prior art are overcome or alleviated by the surface mount multimedia outlet of the present invention.

The invention comprises several embodiments including from one to six ports. The number of ports open is dictated by both housing size and bezel openings. There are two most preferred housing sizes; these relate to a two-port capability and a six-port capability. The number of actual ports open in each of these embodiments will be predetermined by the bezel chosen. It is important to note that the bezels contemplated for use in either housing size, all include two ports and that in a larger housing several bezels will be employed seriatim. Bezels also offer telescopic doors to protect temporarily unused connectors as opposed to at least semi-permanently unused connectors, which would employ blanks. The telescopic doors protect the connector from dust and the like, but are considered optional equipment. It should be noted that the bezel is also alternatively utilized as a connection anchor/support for fiber optic cable applications. Fiber optic connectors are secured directly to the bezel and can then be moved about the housing (six port only) by sliding the bezel out of its channel and moving it to another location without disconnecting the fiber or coaxial connection. To facilitate this moveability, sufficient slack in the cable within the housing must be provided.

The units are aesthetically pleasing as well as being smaller than prior art units of similar capability. One feature of the invention leading to the size reduction accomplished is that connectors are mounted on slides as opposed to being snapped in as many prior art devices are. This allows the use of less plastic in the molding of the ports since no deformation of the part is necessary. This facility of making parts thinner also provides an economic savings when considered in terms of bulk production. A further benefit to slide mounted connectors is that both shielded and non-shielded connectors utilize the same mounts. Thus, a single slide-in engagement arrangement is applicable to shielded and non-shielded connectors. This provides a savings in both engineering time expended and in tooling-up for production.

Even though the two port housings are remarkably small they do not sacrifice such things as multiple raceway/cable entry points. Moreover, not only are such points provided on all three available sides of the housing (in an aesthetically pleasing segmented breakout manner) but the bottom of the unit also provides entry from that point. The segmented breakouts are located on each side except where the ports are located (front). This allows an installation technician to tailor the housing to the particular application by only removing as many segmented knockouts as are necessary to provide proper cable/raceway entry. This leaves other sides of the housing intact with no unsightly holes. The two port housing is therefore extremely appealing to the trade and consumer market combined.

Turning now to the six-port housing, additional features are provided. Importantly, the six-port housing includes an in-housing cable management system which maintains minimum bend radii to satisfy industry standards. This is a tremendous advantage, especially in a minimally dimensioned multimedia outlet.

Moreover, the six port housing utilizes the same bezels utilized in the two port housing. This benefits economically for the reasons set forth with respect to repetition of engineering time, but also provides the added benefit of allowing bezels configured for different connectors (i.e., modular connectors, fiber optic connectors, etc.) to be moved to other locations within the three two-port openings of the front of the six port housings at any time at all without significant modifications. This can be particularly beneficial when furnishings in a workspace are being rearranged or telecommunications devices are being arranged, as crossed wires can be avoided.

Another advantage of the present invention (both two and six port housings) which contributes to the minimal dimensions of the housing is the particular configuration of the category 5 jack. The technology employed in the PCB subassembly category 5 connectors described in U.S. Pat. No. 5,295,869, assigned to the assignee hereof and incorporated herein by reference, is employed herein as well, however, the configuration of the PCB and the S110 termination block are in-line with the jack to promote a space savings. 110 termination blocks are, of course, also beneficial because of the ease of cable termination provided thereby for the installer.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENTS

Figure 6:
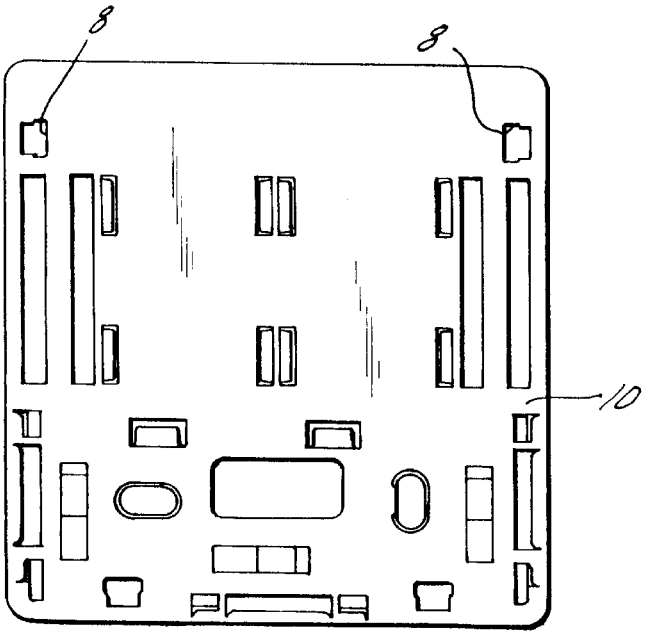
FIG. 6 is a bottom view of the two port outlet of the invention.
Figure 7:
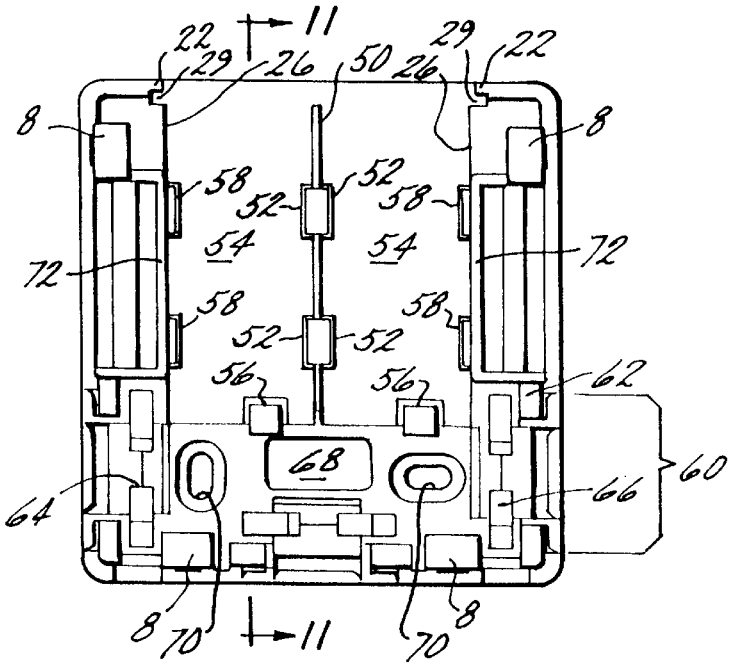
FIG. 7 is a plan view of the bottom interior of the two port outlet of the invention.
Figure 14:
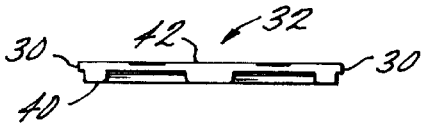
FIG. 14 is a top view of FIG. 12.
Figure 14A:
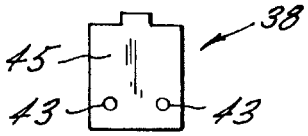
FIG. 14*a* is a blank of the invention.
Figure 12:
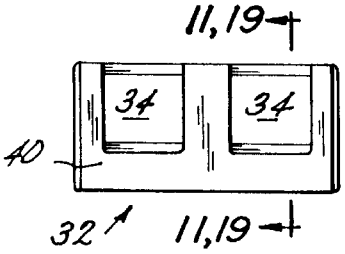
FIG. 12 is a front view of a bezel of the invention.
Figure 13:
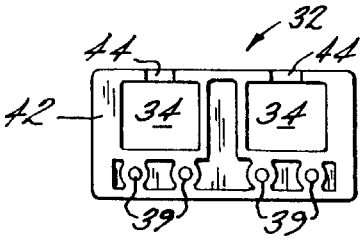
FIG. 13 is a rear view of the bezel in FIG. 12.
Figure 15:
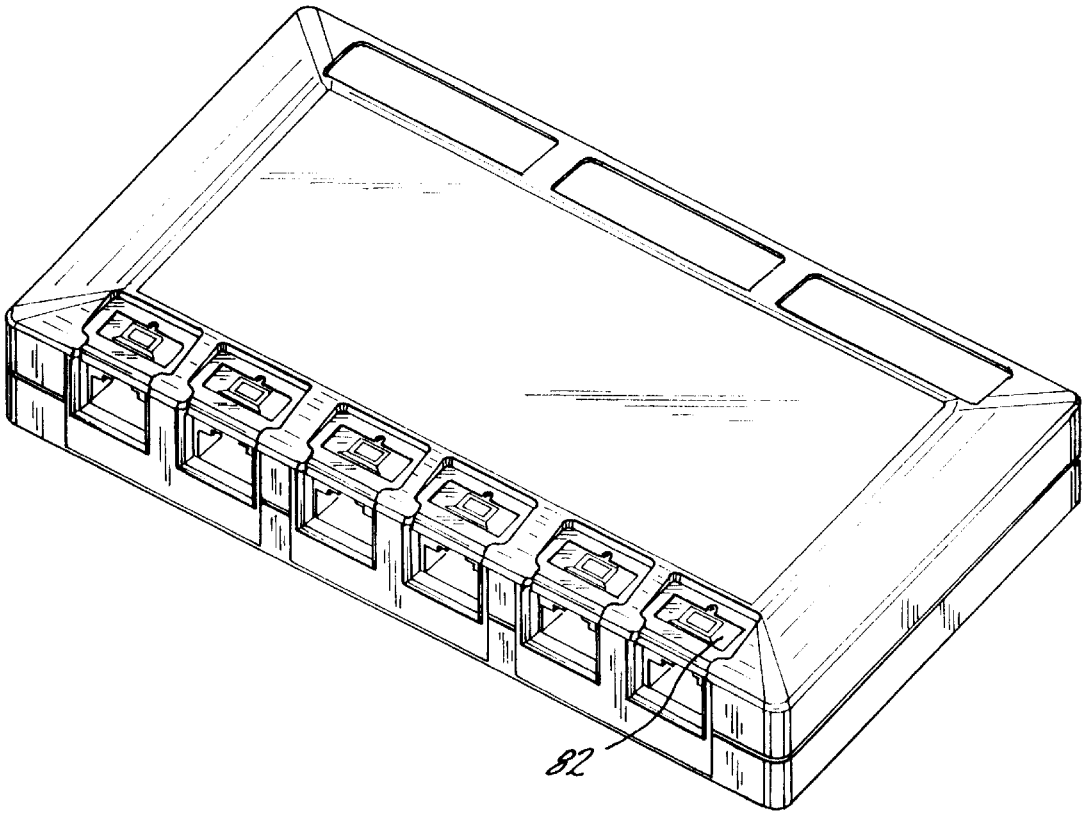
FIG. 15 is a perspective view of a six port outlet of the invention.
Figure 16:
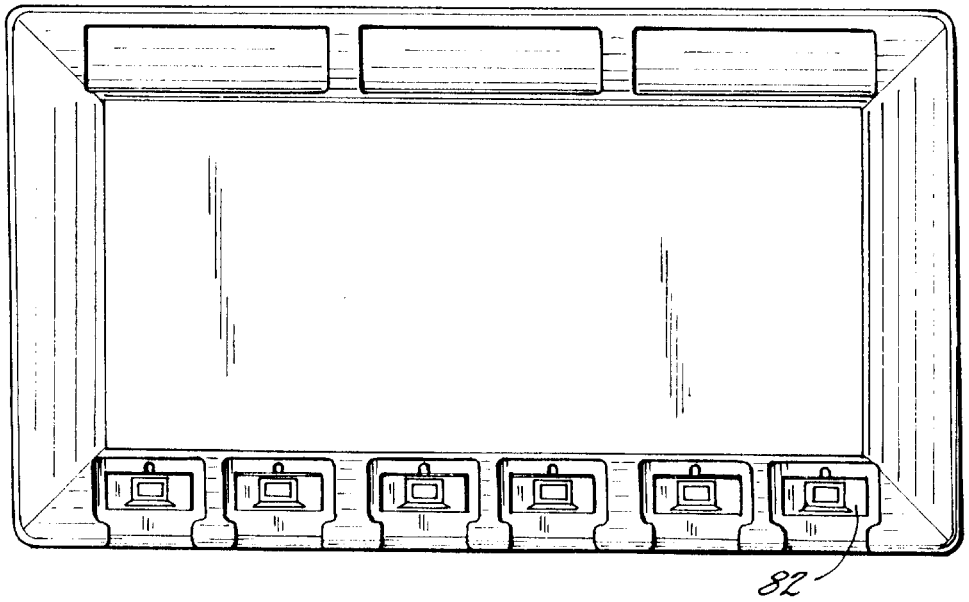
FIG. 16 is a plan view of a six port outlet of the invention.
Figure 17:
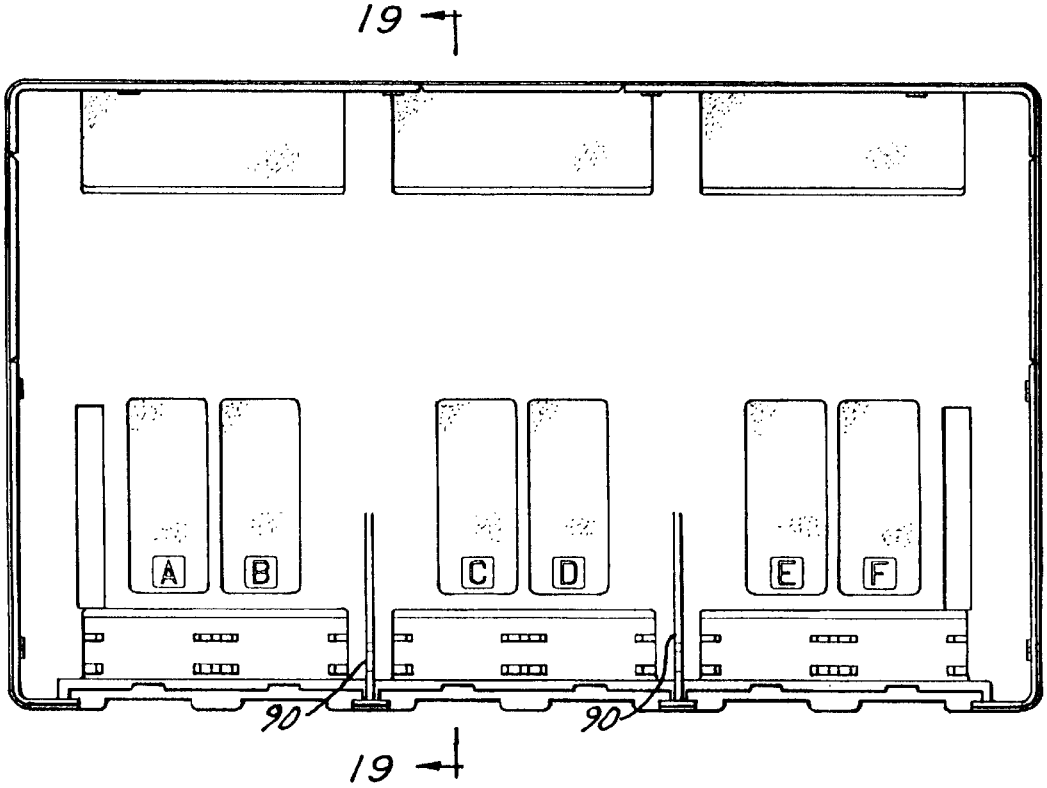
FIG. 17 is a plan view of the underside of the cover of a six port outlet of the invention.

In the first preferred embodiment of the present invention a two-port surface mount multimedia outlet is presented. Enclosure 2 of the two-port housing embodiment includes a base 4 and a cover 6 which are snaplockingly attachable to one another using snaplock latches 8 preferably molded up from bottom 10 of base 4, this is illustrated in FIGS. 6 and 7. Both the base 4 and cover 6 include perimetrical side walls 12 and 14, respectively. Perimetrical sidewalls 12, 14 are continuous walls, curved at the corners, around the entire perimetrical region of bottom 10 of base 4 and top 11 of cover 6. Perimetrical sidewalls 12, 14 include cut-outs 16, 18 for a pair of connectors. When base 4 and cover 6 are engaged, cutouts 16, 18 form one opening 20 in enclosure 2 which is blocked from view and occupied by bezel 32. (Note each pair of cutouts 16, 18 form one opening 20. This is important for six-port enclosures discussed below). Cutouts 16, 18 further include shoulders 22, 24, respectively, which in combination with opposed shoulders 26, for base 4 and support wall 79 for cover 6 define a channel for insertion edge 30 (FIG. 14) of bezel 32. Bezel 32 slides into engagement with both base 4 and cover 6.

Figure 8:
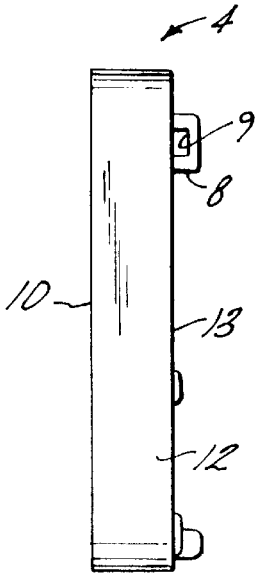
FIG. 8 is a side view of the two port outlet of the invention with the cover removed.
Figure 10:
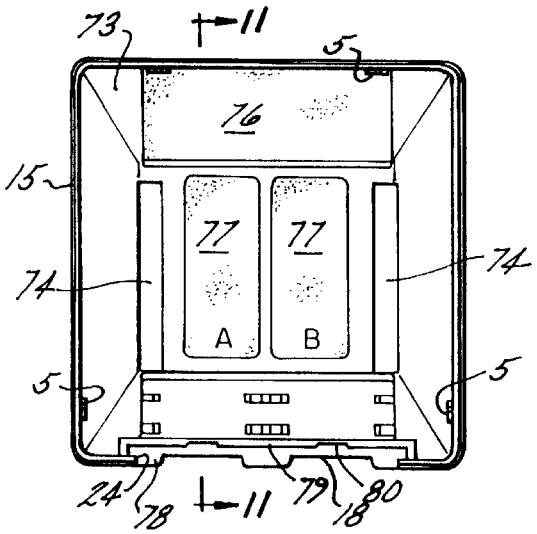
FIG. 10 is a plan view of the underside of the cover of the two port outlet of the invention.

Elaborating on the attachability of base 4 and cover 6, reference is made to FIGS. 7, 8 and 10. Latches 8 each are constructed from upright 7 having undercut 9. Upright 7 extends in a direction generally perpendicularly to the plane of bottom 10 of base 4 for a distance slightly higher than a top edge 13 of base sidewall 12. Undercut 9 is also positioned slightly higher than top edge 13 but not as high as upright 7 extends. Each undercut 9 engages with a snap 5 which is located adjacent lower edge 15 of sidewall 14, when cover 6 is pressed onto base 4.

The bezel 32 (FIGS. 12, 13, 14 and 1) referred to above is an interchangeable member having several configurations. In the first configuration of the bezel two ports 34 are employed. Ports 34, individually, may be open (first configuration) or openably concealed by a door 36 (second configuration; to be discussed hereunder). Ports 34 may also be closed off by a blank 38 (third configuration).

Bezel 32 is engaged with enclosure 2 by slidingly mating bezel edge 30 with the channel 29 defined by shoulders 22, 24 and opposed shoulders 26 for base 4 and support wall 79 for cover 6. Generally bezel 32 is inserted in either cover 6 or base 4 first and then guided into the other during assembly. It should be noted that if a modular connector is to be employed, it would be mounted in base 4 prior to mounting bezel 32.

Bezel 32 includes front and rear surfaces. Front surface 40 is surfaced to be aesthetically pleasing while rear surface 42 includes two foramen 39 underneath each port 34 designed to aid in providing a positive engagement of a blank 38 where such a blank is employed. Blank 38 includes at least one nub 43 and preferably two nubs 43 projecting from the front surface 45 of blank 38 in a position sufficient to mount blank 38 to close port 34. Moreover, an indentation 44 in the rear surface 42 of bezel 32, above and immediately adjacent each port 34, is provided to support blank 38 between cover 6 and bezel 32. Therefore, blank 38 is supported both at a lower end and an upper end thereof so that a durable closure of the port 34 is accomplished. A blank 38 is used only when the port is intended to be closed for an indeterminate time period. Blank 38 can, of course, be removed subsequently, if desired, to provide additional connections at any time.

Figure 1:
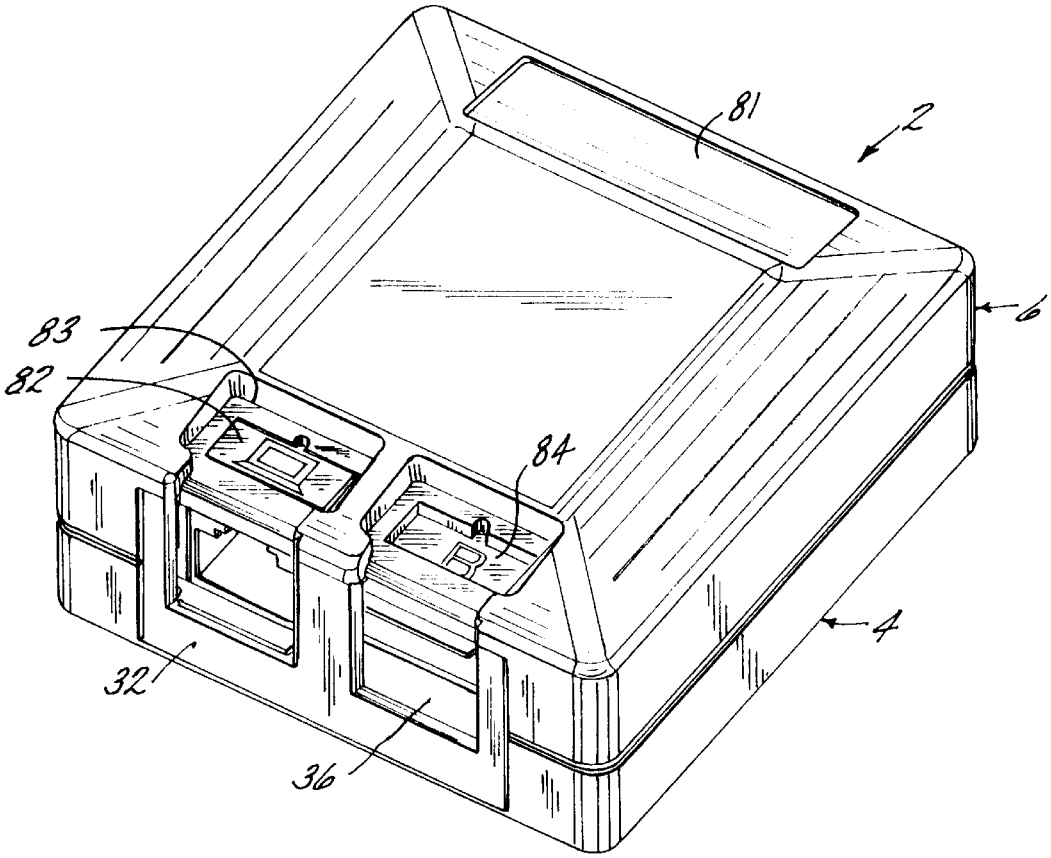
FIG. 1 is a perspective view of the two port outlet of the invention.
Figure 2:
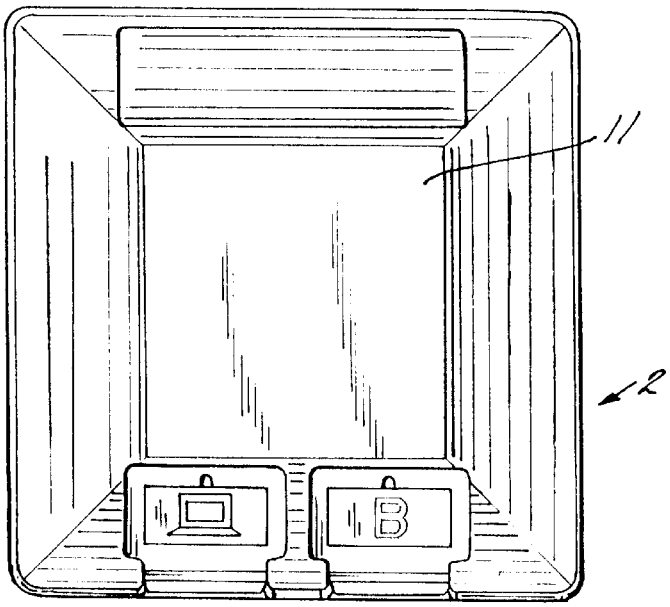
FIG. 2 is a plan view of the two port outlet of the invention.
Figure 3:
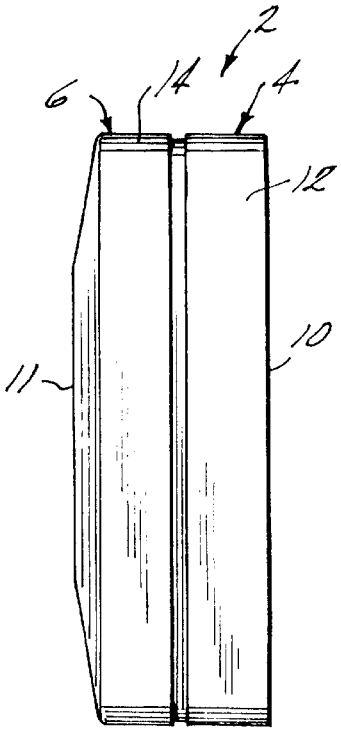
FIG. 3 is a side view of FIG. 2.
Figure 4:
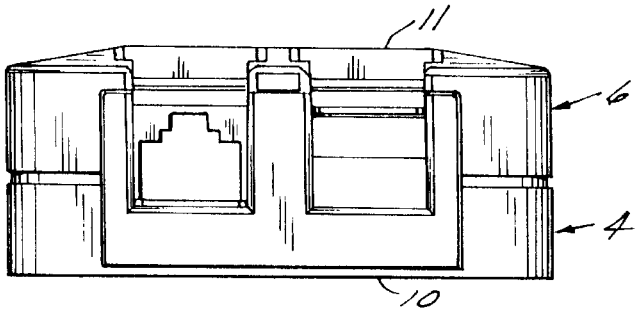
FIG. 4 is a front view of the two port outlet of the invention.

Referring to FIG. 1, where a port 34 is intended to be employed on a regular basis and protection of the connector therein is desired when not in use, a door 36 may optionally be provided to selectively close off said port. Door 36 is preferably of two part telescoping construction. This ensures that door 36 is openable in the smallest possible space, thus maintaining a low overall profile of the outlet. When a plug (not shown) is inserted into a connector, the door 36 will be pushed open thereby, however when the plug is removed the door 36 will snap shut under the urging of at least one conventional coil spring 37. The door 36 operates by pushing downward toward bottom 10 with either a plug or finger tip. The top and bottom doors ride on runners formed by the front and back of the housing which contains the doors. The top door has two springs and two tabs. The springs push on the top door and the tabs connect the bottom door which is just along for the ride.

Figure 27:
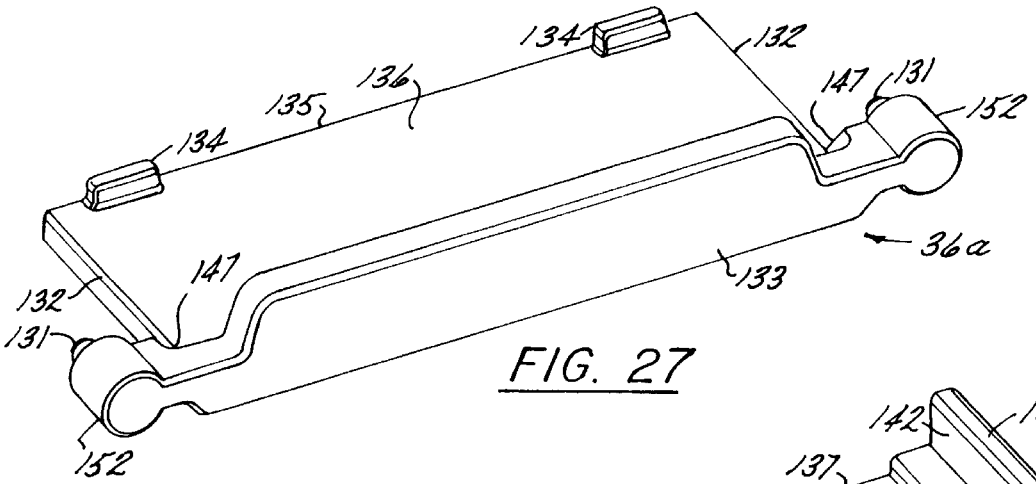
FIG. 27 is a perspective view of the top door of the invention.
Figure 28:
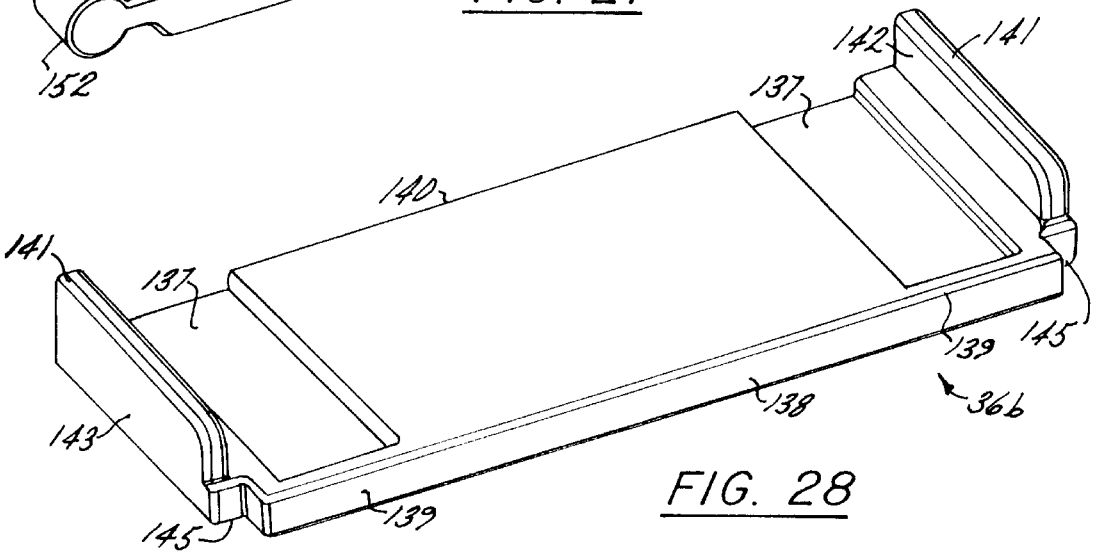
FIG. 28 is a perspective view of the bottom door of the invention.
Figure 29:
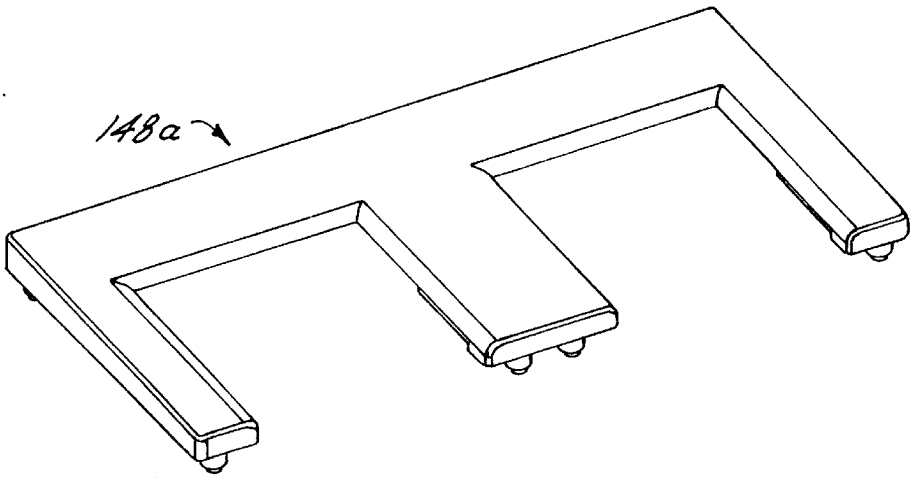
FIG. 29 is a perspective view of the front section of the door bezel of the invention.
Figure 30:
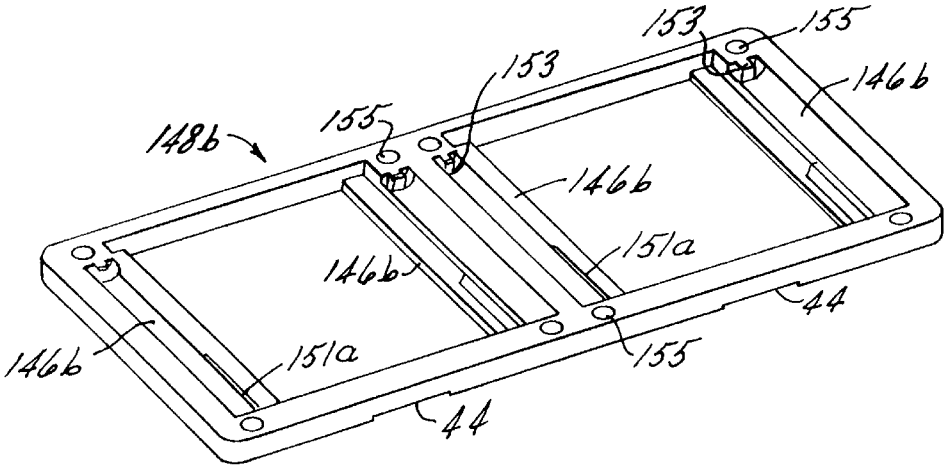
FIG. 30 is a perspective view of the rear section of the door bezel of the invention.
Figure 31:
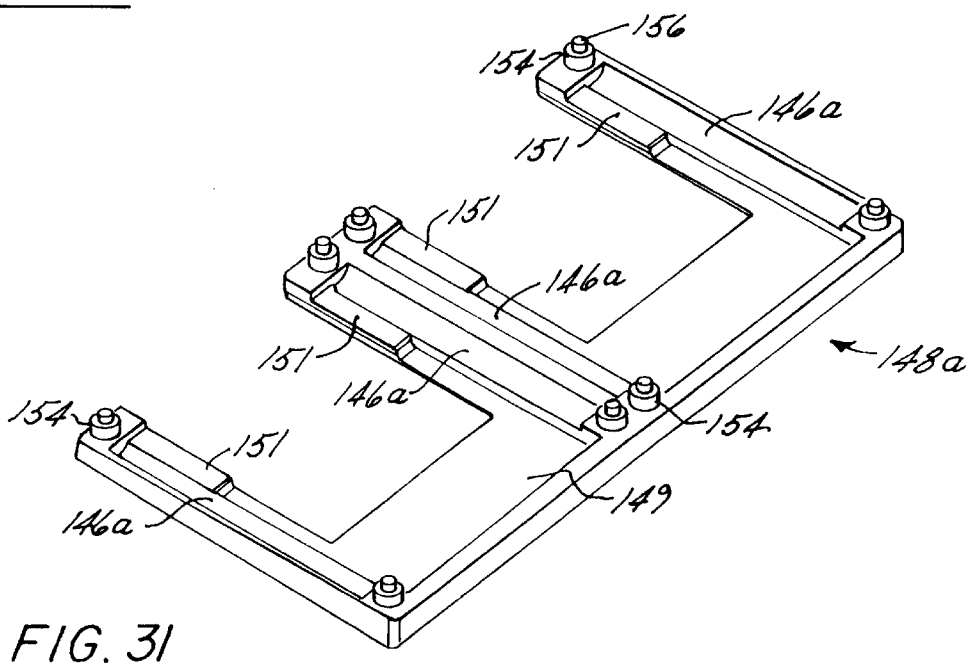
FIG. 31 is a perspective view of a rear surface of front section of the door bezel of the invention.
Figure 32A:
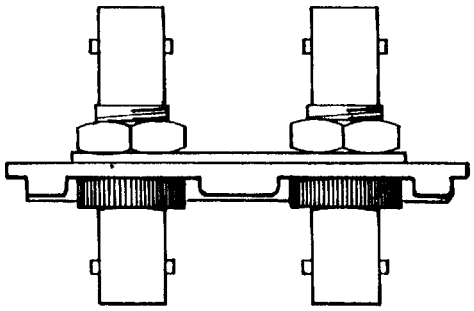
FIG. 32*a* is a top view of an ST fiber optic cable connector mounted in a bezel of the invention.
Figure 32B:
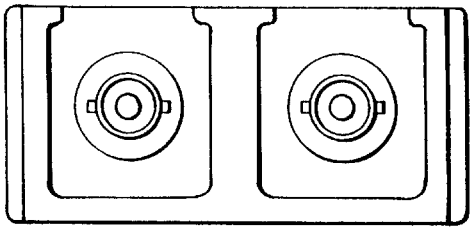
FIG. 32*b* is a plan view of an ST fiber optic cable connector mounted in a bezel of the invention.
Figure 32C:
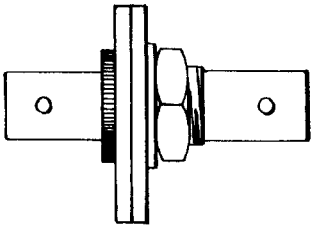
FIG. 32*c* is a side view of an ST fiber optic cable connector mounted in a bezel of the invention.
Figure 33A:
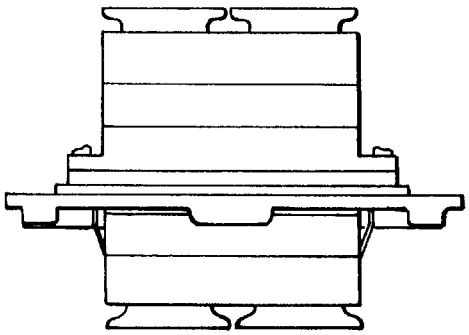
FIG. 33*a* is a top view of an SC fiber optic cable connector mounted in a bezel of the invention.
Figure 33B:
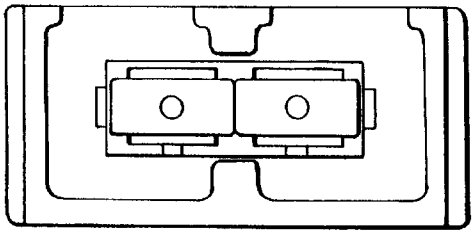
FIG. 33*b* is a plan view of an SC fiber optic cable connector mounted in a bezel of the invention.
Figure 33C:
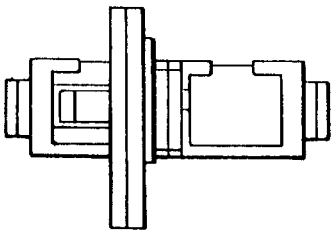
FIG. 33*c* is a side view of an SC fiber optic cable connector mounted in a bezel of the invention.
Figure 34A:
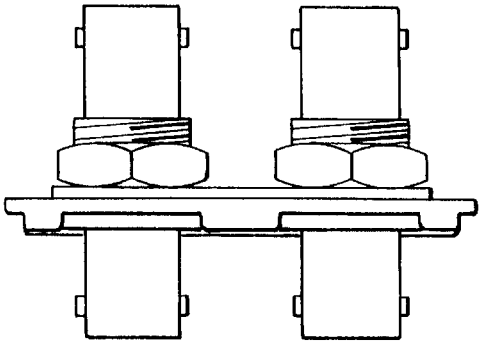
FIG. 34*a* is a top view of a BNC coaxial connector mounted in a bezel of the invention.
Figure 34B:
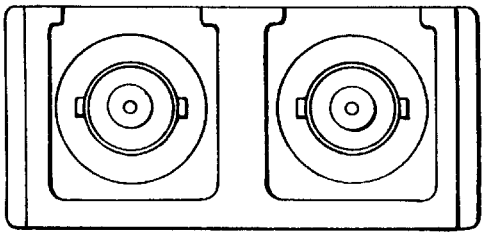
FIG. 34*b* is a plan view of a BNC coaxial connector mounted in a bezel of the invention.
Figure 34C:
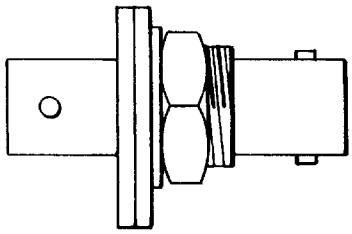
FIG. 34*c* is a side view of a BNC coaxial connector mounted in a bezel of the invention.
Figure 35A:
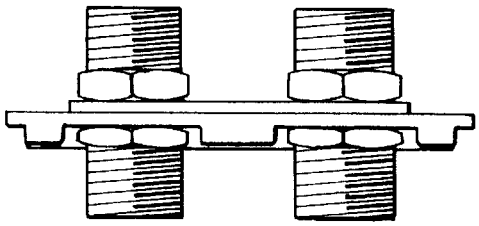
FIG. 35*a* is a top view of a F-81 coaxial connector mounted in a bezel of the invention.
Figure 35B:
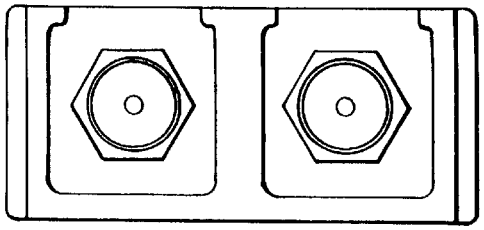
FIG. 35*b* is a plan view of a F-81 coaxial connector mounted in a bezel of the invention.
Figure 35C:
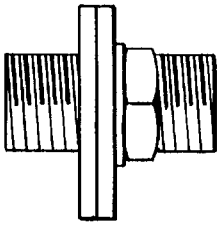
FIG. 35*c* is a side view of a F-81 coaxial connector mounted in a bezel of the invention.

Referring to FIGS. 27–31, doors 36 are an important feature of the invention in and of themselves because they are openable in a very small space. In order to accommodate space limitations, doors 36 are constructed of two telescopically arranged sections: top section 36*a* and bottom section 36*b*. Top door section 36*a* is illustrated in FIG. 27 and includes rounded spring knobs 131 on each of two lateral sides 132 of top-door 36*a*, to engage actuation springs 37. One spring 37 is shown in track 146*b* in FIG. 30. Springs 37 are not shown in each track 146*a* and 146*b* for clarity. In the preferred embodiment, there are two springs 37 for each door 36 assembly. Top door 36*a* employs a ridge 133 for gaining purchase on door 36 to open the same. It will be appreciated by one of skill in the art from the following description of the door 36 mechanization, that springs 37 are operatively engaged only with top door 36*a* and do not directly influence the movement of bottom door 36*b*. Therefore, moving of bottom door 36*b* is carried out by door tabs 134 positioned at a lower edge 135 of top door 36*a*. Door tabs 134 project generally perpendicularly to the major surface 136 of top door 36*a*. Door tabs 134 engage in sliding cooperation with door channels 137 on bottom door 36*b*. Bottom door 36*b* is illustrated in FIG. 28.

As will be appreciated from FIG. 28, door channels 137 do not extend completely from top edge to bottom edge of bottom door 36*b*, rather the channels stop at a point just below top edge 138 of bottom door 36*b* creating stops 139 for engagement with door tabs 134. One of skill in the art will readily understand that when top door 36*a* is urged against the bias of springs 37, door tabs 134 travel downwardly in door channels 137 allowing bottom door 36*b* to move downwardly into the open position under the force of gravity. When bottom door 36*b* reaches its lowest point, tabs 134 merely proceed to a lower edge 140 of bottom door 36*b*. In effect, top door 36*a* is virtually nested with bottom door 36 and port 34 is open. In the closing of door 36, top door 36*a* is urged by springs 37 and bottom door is dragged into a closed position by the door tabs 134.

Other features of bottom door 36*b* include raised edges 141 having inside surface 142 for smoothly guiding top door 36*a* and outside surface 143 for helping to retain springs 37 in tracks 146*a* and 146*b*. Bottom door 36*b* also includes Rabbets 145 which promote nesting with top door 36*a* by being received in notches 147 in top door 36*a* in the open position of door 36.

Both top door 36*a* and bottom door 36*b* are received, in sandwiched relationship, front and rear door bezels 148*a* and 148*b*. Door bezel 148*a* defines, on a rear surface 149 thereof, four spring tracks 146*a* which when door bezel 148*a* is mated with door bezel 148*b*, complete cylindrical voids by union of spring tracks 146*a* and 146*b*, 146*b* being on a front surface 150 of rear door bezel 148*b*. It is axiomatic, when considering the construction of spring knobs 131 that door slides 152 are trapped within spring tracks 146*a* and 146*b*. Therefore, it is understood that springs 37 are maintained between spring knobs 131 and spring pegs 153 and are operable in urging top door 36*a* into a closed position. It should be noted that upon opening of the door 36 and concomitant compression of springs 37 outside surface 143 of raised edge 141 assists in preventing springs 37 from moving out of track 146*a* and 146*b*.

In order to assemble front door bezel 148*a* and a rear door bezel 148*b*, bosses 154 are provided on rear surface 149 of front door bezel 148*a*, and boss holes 155 in front surface 150 of rear door bezel 148*b* are provided to engage bosses 154. As can be ascertained from drawing FIG. 31, bosses 154 are of stepped configuration. This provides for an engagement part 156 and a spacer part 157 on each boss 154. Engagement part 156 is received in boss holes 155 and spacer part 157 butts up against front surface 150 of rear door bezel 148*b*. Construction of these parts provides a reliable function and aesthetically pleasing door bezel for use with the present invention. It should be noted that the door bezel is engageable with the outlet in the same manner as non-door bezels of the invention.

Figure 9:
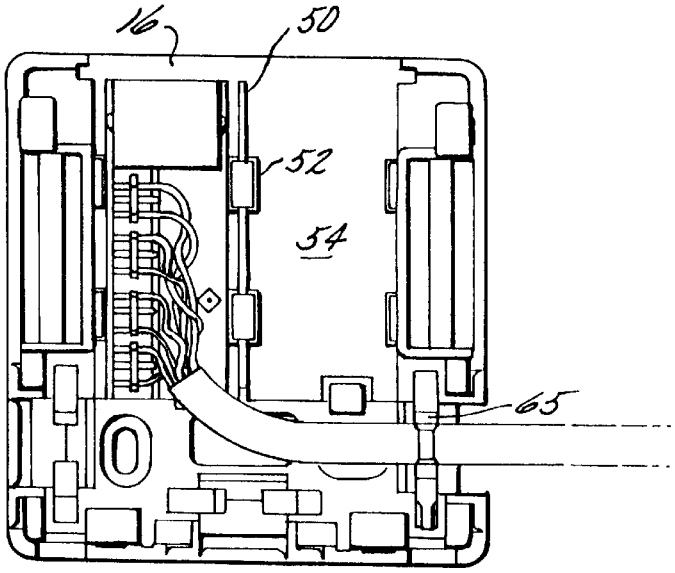
FIG. 9 is a plan view of the interior of the two port outlet of the invention with a slide in modular connector and wiring installed.

Referring now to FIGS. 7 and 9 the areas confined within a two port enclosure 2 will be discussed. Extending from bottom 10 are many structures utilized in the preferred embodiment. A center wall 50 extends perpendicularly to the plane of bottom 10 and includes slides 52 for sliding engagement with a connector (discussed, infra). Center slides 52 on center wall 50 are four, in preferable number, and are arranged two on each side of center wall 50, and each opposing one of the two on the other side of center wall 50. Center wall 50 divides two bays 54 aligned with each port 34. Each bay 54 preferably contains not only two center slides 52 but a rear slide 56 and side slides 58. These in cooperation; engage a connector in each bay 54. Each slide is molded from bottom 10 to form an inward facing hooked structure (inward meaning toward a central region of each bay 54).

Base 4 further includes segmented breakouts 60 in base sidewall 12. Segmented breakouts 60 located on each of three sides of the outlet, the three sides excluding the port side (front) allow a technician in the field to provide cable or raceway access in a proximate size so that aesthetics of the outlets are maintained. Another important feature of segmented breakouts 60 is that they extend very closely to bottom 10 of enclosure 2, thereby avoiding the necessity of bending the cable to enter the outlet. Such bending is common in prior art devices, is onerous to the technician, detrimental to the cable and detracts from the appearance and function of the unit. The cable in the invention is ramped into the outlet by ramped cable restraint 64.

Figure 19:
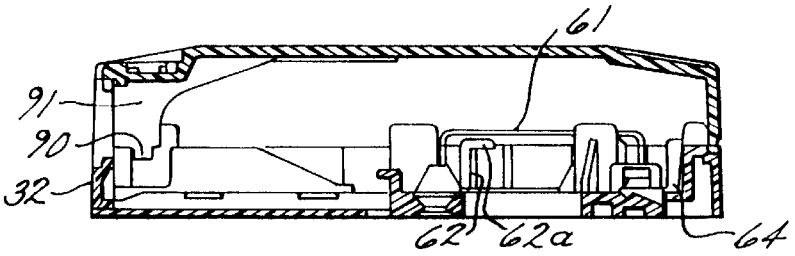
FIG. 19 is a cross section taken along section line 19—19 in FIGS. 12, 17 and 18.

Once the desired number of breakouts are removed, cable/raceway enters the enclosure 2 and is butted against hold down members 62. Hold down members 62 include 62*a* illustrated in FIGS. 11 and 19. Ramped cable restraints 64 are also provided. Restraints 64 preferably provide apertures 66 for through passage of conventional cable ties 65 (see FIG. 9). Other methods and apparati of restraining cable are equally effective.

In the preferred embodiment ramped cable restraint 64 extends upwardly from bottom 10 gradually from a more perimetrical portion of bottom 10 to a more inward portion of bottom 10. At a predetermined peak height the restraint drops off more quickly than it extended upwardly. This provides an edge to grip the outer jacket of a cable and effectively relieves strain therein.

Figure 11:
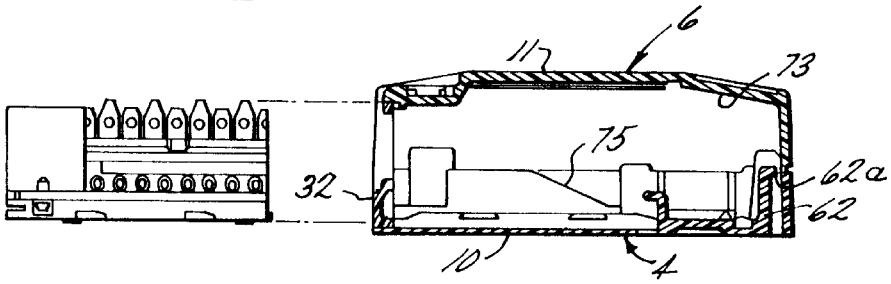
FIG. 11 is a cross section view taken along section lines 11—11 in FIGS. 5, 7, 10 and 12.

Hold down members 62 are configured much like slides 52, 56 and 58, however, are much larger in size. These are positioned in various locations within the cavity as illustrated in FIGS. 7, 11.

In addition to breakouts 60, duct 68 is provided in bottom 10 in the preferred embodiment for alternative entry of cable or raceway, thereby accommodating all different situations. It should also be noted that where circumstances or cable thickness require, cover breakouts 61 are provided to enlarge the breakout area.

The final features of base 4 are slotted mounting holes 70, and magnet cradles 72. Slotted mounting holes 70 allow proper leveling and/or squaring of the unit and are for use with threaded fasteners. Magnet cradles are preferably rectangular in plan view as shown in FIG. 7, however, can be of any desired shape subject to space limitations. In the most preferred embodiment, at least one side of magnet cradle 72 includes an angled wall 75 (FIG. 11) so as to expose the upper part of the inserted magnet for easier removal thereof as well as allow easier insertion of cable tie when magnet is not in place, more room for fingers. Magnets may be secured by any conventional means, including but not limited to press fit, glue, pinned, etc. The cover when closed holds the magnets in place.

Referring now to FIG. 10 a view of the underside of cover 6 is provided. This FIGURE clearly shows snaps 5 for engagement with undercut 9 of upright 7 discussed above. This FIGURE further illustrates important grooves 74. Grooves 74 are placed on underside 73 of cover 6 to accommodate internal components of the outlet when cover 6 is attached. Groove 74 is preferred because of the angled elevation of the cover 6 for aesthetic purposes.

Underside 73 of cover 6 also includes identification areas. Label area 76 are large areas having a textured surface so that a technician may write directly thereon. Write-on zones 77 coincide with exterior tab areas for more detailed information.

Cover 6 includes a bezel reception area 78 having a bezel support wall 79 with depressions 80. Wall 79 extends just behind the installed bezel 32. Depressions 80 meet with indentation 44 on bezel 32 to provide sufficient room to contain finger 41 of blank 38. Area labeled 76 are for an appropriate sized sticker label.

In the preferred embodiment, utilizing tabs 82 for surface identification of connectors, pockets 83 are provided in cover 6 to retain tabs 82 in position. A further explanation of the tab can be found in U.S. Pat. No. 5,295,869 which is assigned to the assignee hereof and incorporated herein by reference.

Figure 5:
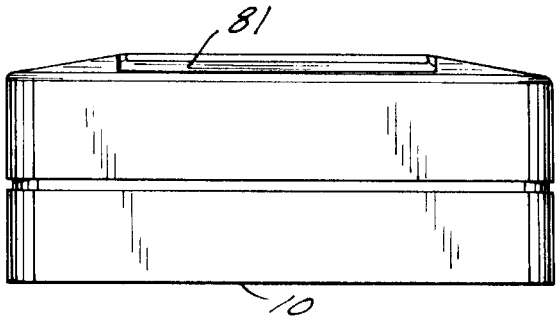
FIG. 5 is a rear view of the two port outlet of the invention.

Further labeling provisions are in label area 81, illustrated in FIGS. 1 and 5. These areas generally are utilized for stick on labels but can be employed for other labeling methods.

For aesthetic reasons, the preferred embodiment of the two-port outlet of the invention includes pockets 83 within which a seat 84 is formed to receive tab 82. Pocket 83 extends forwardly to open at a front edge of cover sidewall 14.

Connectors utilized with the enclosure to produce a multimedia outlet are discussed following the discussion of the alternative six port housing of the invention.

In the second embodiment of the invention, a six port surface mount multimedia outlet is disclosed. The six port embodiment is illustrated in FIGS. 15–18 and is substantially similar to the two port embodiment, but includes more space than that available in the two port enclosure and some additional structure to accommodate additional connectors as well as to maintain stability of the unit.

In the interest of maintaining clarity of the description, like elements will be numbered alike in the drawings and not discussed in depth hereunder. Those elements discussed hereunder are unique to the six-port embodiment. It will be understood that the six port embodiment encompasses all of the features of the two port embodiment.

Figure 18:
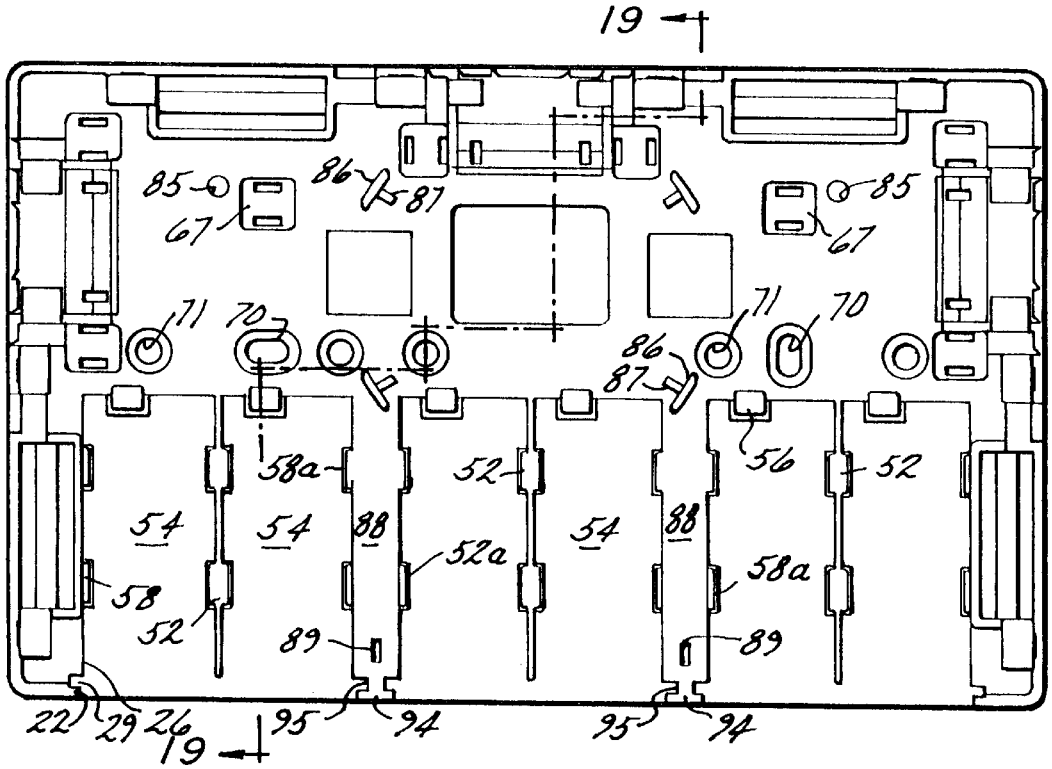
FIG. 18 is a plan view of the interior of the bottom section of a six port outlet.

Unique to the six port embodiment, as illustrated in FIG. 18 is an excess cable management system including, in the most preferred arrangement, a series of four radiused posts 86 having post supports 87 providing cable management with industry standard minimum bend radius specifications. For example, fiber optic cable is managed with a 1.18 inch bend radius or greater and unshielded twisted pair are maintained at four times the outer diameter of the outer jacket of the cable. Radiused posts 86 have been engineered to encompass, not yet released but expected, standards for shielded twisted pair and coaxial cables.

In addition to the above, the six port outlet includes polls 85 and additional cable tie members 67. These help in routing and securing cable.

As best illustrated in FIGS. 15, 17, 18 and 19; the six port embodiment employs the two port configuration for each pair of connectors, i.e., bays 54 are flanked by center slides 52, rear slide 56 and side slides 58. The difference, clear to one of ordinary skill, is that the pair of bays 54 are repeated three times. It should be noted that side slides 58 which are positioned on interior portions of the six port embodiment, are designated 58*a* for clarity; side slides 58*a* are on opposed sides of a wide, bay-pair division wall 88. Bay-pair division wall 88 further includes receptacles 89 for receiving alignment lugs 90, protruding from braces 91. Each brace 91 includes one alignment lug 90.

Another feature of division wall 88 is to provide a coupling structure 94 for receiving bezel 32. Bezel 32 is identical whether utilized in conjunction with a two port enclosure or a six port enclosure. Therefore, it is expedient to provide a channel 95 to receive the bezel when multiple openings are present.

A final feature of the six port outlet is additional screw holes 71 for secure mounting of the outlet.

Figure 22:
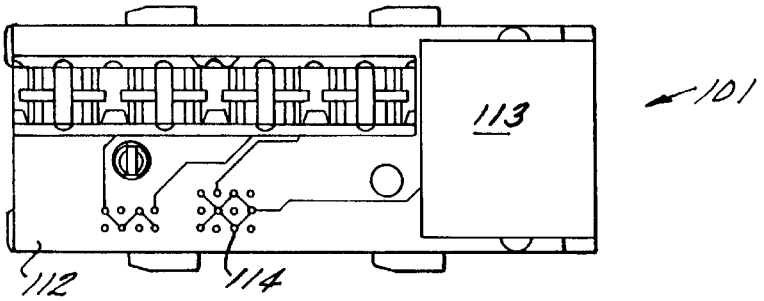
FIG. 22 is a plan view of FIG. 20.
Figure 20:
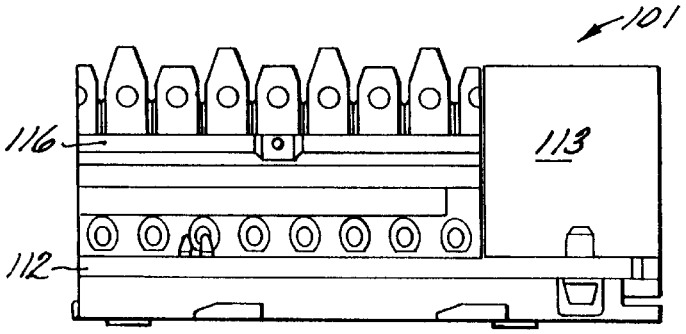
FIG. 20 is a side view of an unshielded connector of the invention.
Figure 21:
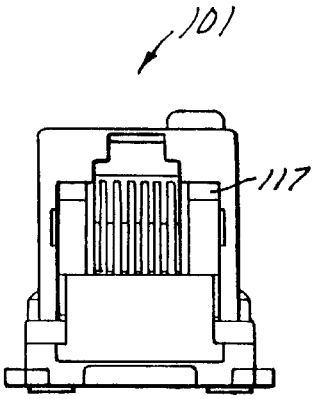
FIG. 21 is an end view of FIG. 20.
Figure 23:
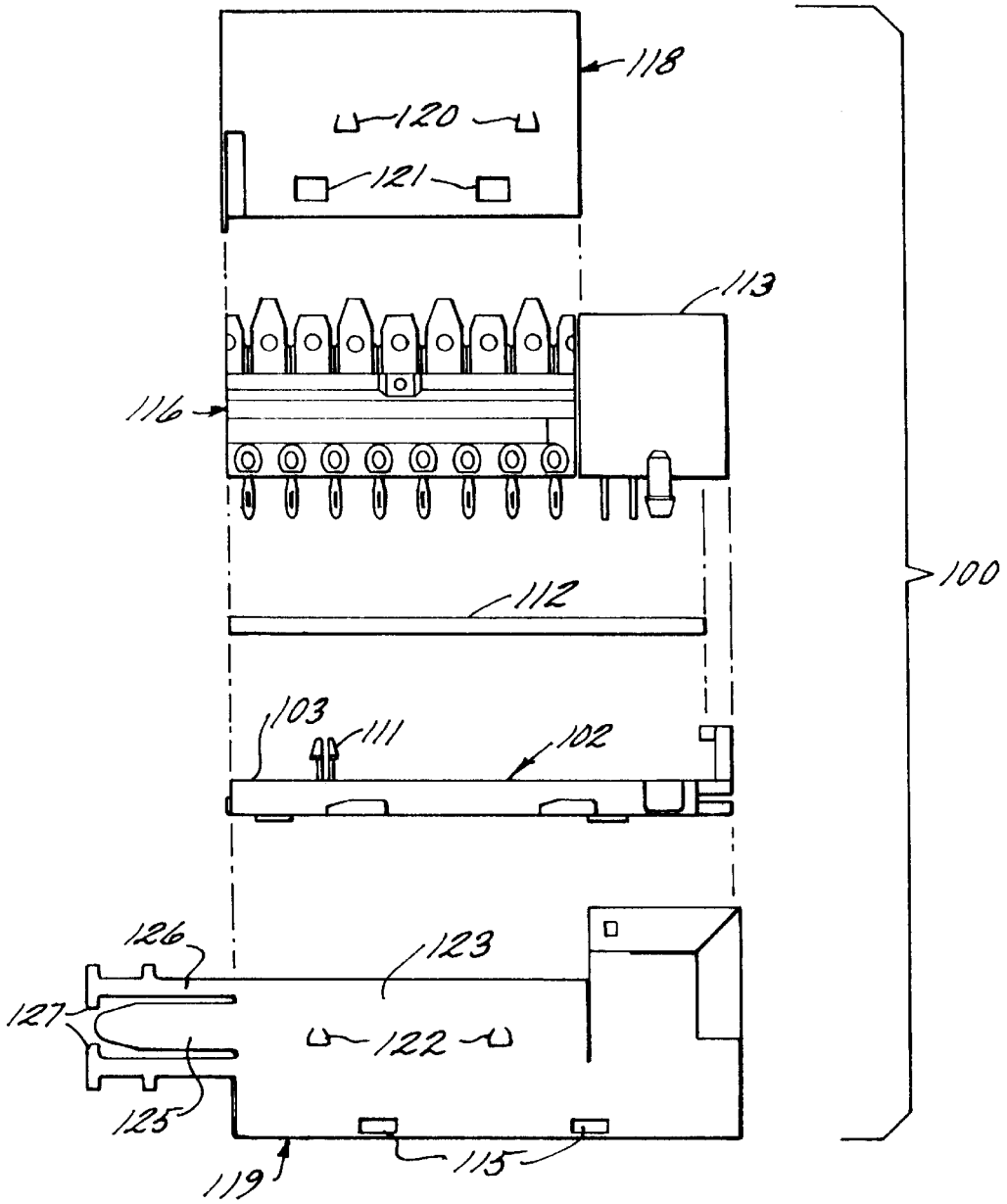
FIG. 23 is an exploded view of a shielded connector of the invention.
Figure 23A:
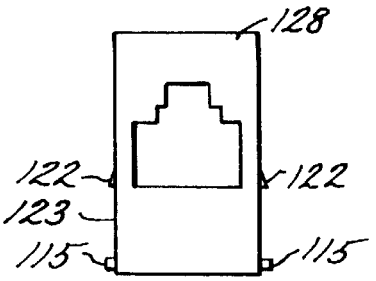
FIG. 23*a* is a front end view of the shielded connector.
Figure 23B:
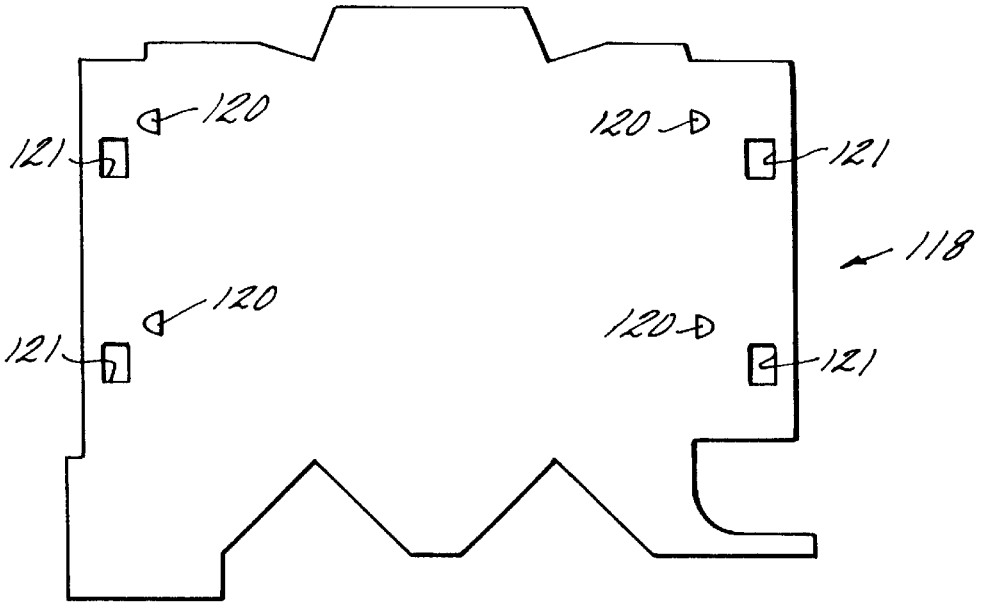
FIG. 23*b* is a view of a shield cover blank before bending.
Figure 23C:
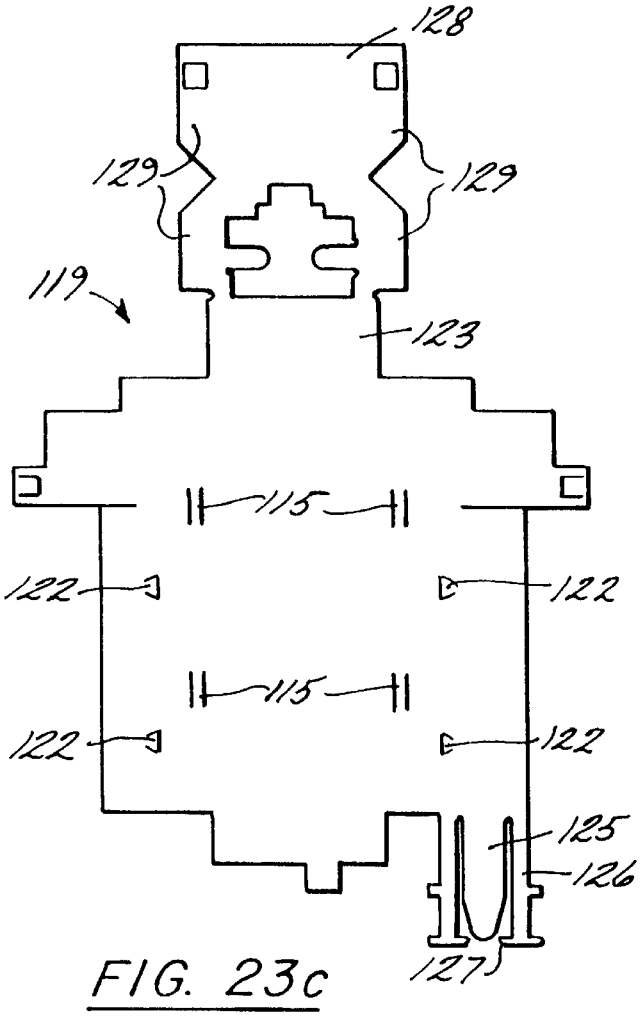
FIG. 23*c* is a view of a shield base blank before bending.

For use with either the two port or six port enclosures is a shielded connector subassembly 100 or unshielded connector sub assembly 101, which are illustrated in FIGS. 20, 21 and 22. Alternatively, a fiber optic connector or coaxial connector may be employed with either the two port or six port enclosures. In the case of these media, the bezel assumes an additional function; the bezel becomes a support for the connector which is secured directly thereto.

Figure 24:
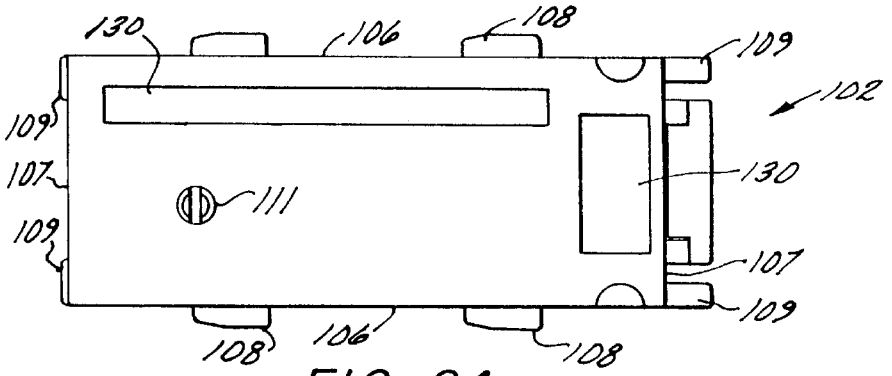
FIG. 24 is a plan view of an insulator used in conjunction with a connector assembly of the invention.
Figure 25:
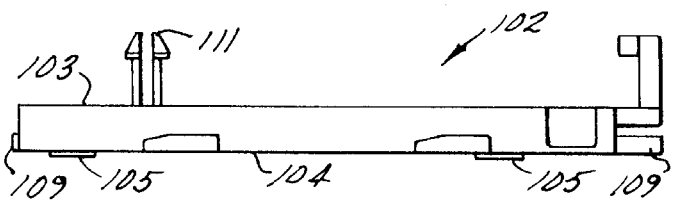
FIG. 25 is a side view of FIG. 24.
Figure 26:
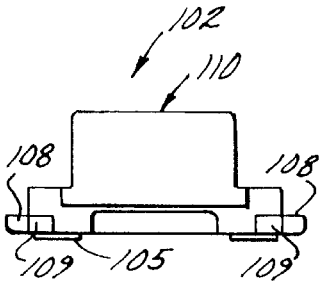
FIG. 26 is an end view of FIG. 24.

The unshielded version of the connector utilizes an insulator 102 illustrated alone in FIGS. 24–26 which functions as a base upon which the subassembly 101 is built. The insulator 102 itself includes a relatively large planar structure having a top surface 103 and a bottom surface 104. Extending generally perpendicularly, in a downward direction from bottom surface 104, (when oriented as it will be combined with the outlets of the invention) are preferably four pedestals 105. These help to align the jack (discussed hereunder) with the opening in the enclosure for positive engagement. Joining the top surface 103 and bottom surface 104 are lateral edges 106 and end edges 107. Extending laterally from lateral edges 106 and adjacent bottom surface 104 are extensions 108. Extensions 108 engage side slides 58 or 58*a*, depending upon which embodiment is contemplated, and center slides 52 when subassembly 101 is installed. Insulator 102 further includes location tabs 109 projecting from end edges 107.

Insulator 102 further includes hollowed out portions 130 to provide room for the leads of the 110 type connector and modular jack discussed hereunder. It is an important function of insulator 102 to provide protection for these leads since they penetrate through the printed circuit board with which they are connected.

Extending from the front end edge 107 is a plug engagement member 110 which extends upwardly from top surface 103 to a predetermined height and then rearwardly for a distance sufficient to positively engage the opening of a modular connector to hold the same against the top surface of the insulator 102. A protrusion 111 also extends from top surface 103 in an upward direction. The protrusion includes a deformable top section for engaging a PC board 112 having a "110" termination 116 block mounted thereon and a modular jack 113 mounted thereon (see FIGS. 20–22). It should be noted that the preferred connector is category five compliant. This compliancy is preferably achieved by using capacitance created by an array of plated holes 114 in the Printed Circuit Board. More detailed discussion of the category 5 PCB can be found in U.S. Pat. No. 5,295,869 previously incorporated herein by reference. This subassembly 101 is then inserted into a bay 54 such that slides 52, 56 and 58 are fully engaged therewith.

In order to complete the assembly of the outlet, the following sequence is preferential. Knockouts should first be removed if necessary to provide raceway or cable access, and the cable secured; next the subassemblies whether shielded 100 or unshielded 101 should be inserted into the bays 54. The number of subassemblies employed is, of course, contingent on which preferred enclosure is utilized and how many blanks will be employed. Once the subassembly of choice has been inserted in bay 54, and wires have been terminated, bezel 32 is inserted in base 4. Finally, cover 6 or 92 is snapped into place and tabs 82 with appropriate color and/or icons are snapped into seats 84. This procedure applies to both shielded and unshielded subassemblies for twisted pair media.

Shielded subassembly 100 in the preferred embodiment is slightly different than unshielded subassembly 101. Shielding, to be effective, must be complete as discussed in U.S. Ser. No. 08/277,079, which is assigned to the assignee hereof and incorporated herein by reference. The basic components of the unshielded unit, including the modular connector, insulator, "110" termination block and PC board are similar however in the preferred embodiment of the shielded connector, some differences exist and a shield is employed. More specifically, with respect to the difference, the insulator 102, to which the PC board is attached, is devoid of extensions 108 in the shielded embodiment. The function of extensions 108 is assumed by protuberances 115 which are located on a lower edge region of the shield. In all other respects the preferred embodiment of the unshielded subassembly 101 is substantially similar to the shielded assembly 100, but for shielding. The shielding is constructed of a conductive material and completely surrounds the connector except for the plug opening 117.

The two-piece preferred arrangement for the shield is shielding cover 118 and shielding base 119. Shielding cover 118 is generally rectangular in shape and includes both land areas 120 and snap orifices 121. Land areas 120 are provided to prevent the shielding cover 118 from becoming two tightly engaged with shielding base 119 thereby preventing possible interference with the outlet due to shorting. Snap orifices are provided for snaplockingly fitting shielding cover 118 to shielding base 119. Snap orifices 121 are dimensioned to engage pawls 122 on shielding base 119 whereafter the entire connector is fully shielded. While in the preferred embodiment, shielding cover 118 is simple, being merely rectangular, shielding base 119 is of a relatively complex shape. Shielding base 119 includes a first side 123 and a second side 124. These sides are identical except for a spike 125 and a strain relieved stanchions 126 with burs 127 which exist only on one side. Excess conductive material 128 is bent to form modular jack cap 128 which engages side 123 through bent wing sections 129. Construction of spike 125, stanchions 126 and burs 127 is possible on either side 123 or 124 of shielding base 119, depending upon the application. It should be noted that the function and usage of spike 125, strain relief stanchions 126 and burs 127 are more fully discussed in copending U.S. Ser. Nos. 08/301,272 filed on Sep. 2, 1994 which is a continuation-in-part of U.S. Ser. No. 08/277,079 filed Jul. 19, 1994 which is assigned to the assignee hereof and incorporated herein by reference.

As mentioned above, the outlets of this invention are useable with fiber optic cable and coaxial cable as well as twisted pair cable. Where fiber optic cable or coaxial cable are employed, the subassembly required for modular jacks are not required. Rather, the bezels 32 are employed directly to support the connectors 130 which are secured thereto. This is illustrated in FIGS. 32, 33, 34 and 35. Connectors utilized in this manner are commercially available from a number of sources, distributors such as Graybar and Anixter by the common name; SC fiber connectors, ST fiber connectors, BNC coaxial connectors and F-81 coaxial connectors.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A surface mount multimedia outlet comprising:

a) a base having at least one slide fit engagement arrangement for removably and interchangeably receiving one of a plurality of types of telecommunications connectors;

b) a cover adapted to engage said base for reliable retention thereon; and c) a bezel removably mounted in a channel formed in said base.

2. A surface mount multimedia outlet as claimed in claim 1 wherein said base includes at least one segmented breakout area for raceway/cable entry.

3. A surface mount multimedia outlet as claimed in claim 1 wherein said base includes at least one structure for holding cable in a desired configuration.

4. A surface mount multimedia outlet as claimed in claim 1 wherein said base includes strain relief structure for engaging a raceway/cable jacket to protect terminations from strain.

5. A surface mount multimedia outlet as claimed in claim 1 wherein said base includes an aperture in a bottom thereof for cable entry.

6. A surface mount multimedia outlet as claimed in claim 1 wherein said base includes an arrangement for retaining at least one magnet for mounting said outlet.

7. A surface mount multimedia outlet as claimed in claim 1 wherein said base includes openings therein to accommodate through passage of fasteners for mounting said outlet.

8. A surface mount multimedia outlet as claimed in claim 1 wherein said cover includes structure to snaplockingly engage latches extending upwardly from said base.

9. A surface mount multimedia outlet as claimed in claim 8 wherein said latches are undercut projections and said structure to snaplockingly engage said latches are structures sized sufficiently to be received in said undercut projections.

10. A surface mount multimedia outlet as claimed in claims 1 wherein said cover further includes, on an underside thereof, provision for labeling.

11. A surface mount multimedia outlet as claimed in claim 10 wherein said provision for labeling is adhesive labels.

12. A surface mount multimedia outlet as claimed in claim 10 wherein said provision for labeling is a textured write-on surface area.

13. A surface mount multimedia outlet as claimed in claim 1 wherein said cover includes grooves to provide clearance in said cover for connectors.

14. A surface mount multimedia outlet as claimed in claim 1 wherein said releasably engageable bezel includes reduced dimension lateral edges of said bezel and a complimentarily shaped engagement shoulder structure in said base and said cover surrounding an area therein through which connections are made.

15. A surface mount multimedia outlet as claimed in claim 1 wherein said outlet is a two port outlet.

16. A surface mount multimedia outlet as claimed in claim 1 wherein said outlet is a six port outlet.

17. A surface mount multimedia outlet comprising:

a) a base having at least one slide fit engagement means for receiving a telecommunications connector subassembly and three segmented breakout areas having for raceway/cable entry located on three of four sides of said base said fourth side being a front having ports for connectors;

b) a cover adapted to engage said base for reliable retention thereon; and c) a bezel removably mounted in a channel formed in said base.

18. A surface mount multimedia outlet comprising:

a) a base having at least one slide fit engagement means for receiving a telecommunications connector subassembly;

b) a cover adapted to engage said base for reliable retention thereon and having at least one breakout area located complimentarily to at least one segmented breakout area on said base when said cover and base are snaplockingly engaged; and c) a bezel removably mounted in a channel formed in said base.

19. A surface mount multimedia outlet comprising:

a) a base having at least one slide fit engagement means for receiving a telecommunications connector subassembly;

b) a cover adapted to engage said base for reliable retention thereon; and c) a bezel removably mounted in a channel formed in said base, said bezel including two ports therein and including a front surface and a rear surface.

20. A surface mount multimedia outlet as claimed in claim 19 wherein said rear surface contains at least one arrangement for engaging a blank to reversibly close a port for a connector, said at least one arrangement including at least one foramen in said rear surface and at least one indentation, said foramen and indentation being arranged adjacent opposed top and bottom edges of at least one port, said foramen being sized to pressfittingly connect with at least one nub on said blank and said indentation being sized to nestle with a blank finger projecting upward from said blank.

21. A surface mount multimedia outlet comprising:

a) a base having at least one slide fit engagement means for receiving a telecommunications connector subassembly;

b) a cover adapted to engage said base for reliable retention thereon; and c) a bezel removably mounted in a channel formed in said base, said bezel including a telescopic door for temporarily closing off a port in said bezel.

22. A surface mount multimedia outlet as claimed in claim 21 wherein said door is spring actuated.

23. A surface mount multimedia outlet comprising:

a) a base having at least one slide fit engagement means for receiving a telecommunications connector subassembly;

b) a cover adapted to engage said base for reliable retention thereon; and c) a bezel releasably engaging a front edge of said base and said cover; and wherein said telecommunications connector subassembly includes:

d) an insulator;

e) a printed circuit board connected to said insulator on a top surface thereof;

f) a modular connector connected to said printed circuit board on a top surface thereof; and g) a termination arrangement also connected to said top surface of said printed circuit board wherein said termination arrangement is connected in-line with said modular connector.

24. A surface mount multimedia outlet as claimed in claim 23 wherein said termination arrangement is an 110 type termination block.

25. A surface mount multimedia outlet as claimed in claim 23 wherein said insulator is composed of non conductive plastic.

26. A surface mount multimedia outlet as claimed in claim 23 wherein said modular connector is a twisted pair connector.

27. A surface mount multimedia outlet as claimed in claim 23 wherein said modular connector is selected from the group consisting of one pair, two pair, three pair or four pair types.

28. A bezel operably engageable with a multimedia outlet comprising:

a) a first surface and an opposed second surface;

b) two ports positioned adjacent one another extending from said first surface through to said second surface, said second surface including a sliding engagement arrangement for engaging a telescoping door, said door blocking said ports when in a closed position and allowing through passage of a predetermined connector when in an open position.

29. A bezel operably engageable with a multimedia outlet as claimed in claim 28 wherein said telescoping door is urged into a closed position by a resilient member.

30. A bezel operably engageable with a multimedia outlet as claimed in claim 29 wherein said resilient member is a spring.

31. A two part multimedia outlet comprising:

a) an enclosure including i) a cover releasably attachable to a base ii) a bezel releasably engageable with said cover and base to form a defined cavity having access openings at a front surface thereof b) a slide-in connector, slidingly engageable with said base by means of a plurality of paired and opposed slides which project upwardly from said base to a predetermined point collectively equidistant from a bottom section of said base whereat each of said pairs of slides bend toward each other at about 90° from the respective upwardly projecting sections, said pair of slides defining a bay, each pair being separated by a distance sufficient to receive said connector.

32. A six port multimedia outlet comprising:

a) an enclosure including

I) a cover releasably attachable to a base;

ii) a bezel releasably engageable with said cover and base to form a defined cavity having a plurality of access openings at a front surface thereof;

b) a plurality of slide-in connectors, engageable slidingly with at least one pair of slides which project upwardly from said base to a predetermined point collectively equidistant from a bottom section of said base whereat each of said slides bend toward each other at about 90° from the respective upwardly projecting sections, said at least one pair of slides defining a bay, each pair being separated by a distance sufficient to receive said connector;

c) a cable manager extending upwardly from said base within said cavity.

33. A six port multimedia outlet as claimed in claim 32 wherein said cover includes alignment lugs for engaging apertures in said base.

34. A six port multimedia outlet as claimed in claim 32 wherein said cable management arrangement maintains cable in a minimum bend radii established for each type of cable.

35. A six port multimedia outlet as claimed in claim 34 wherein said type of cable is twisted pair.

36. A six port multimedia outlet as claimed in claim 35 wherein said bend radii is four times an outer diameter of an outer jacket of said cable.

37. A shielded slide-in connector comprising:

a) an insulator;

b) a printed circuit board connected to said insulator;

c) a termination block and modular connector both fastened to said printed circuit board;

d) a shielding enclosure having at least one arrangement for engaging a cable to complete the shield.

38. A shielded slide-in connector as claimed in claim 37 wherein said shielding enclosure is comprised of two parts engageable to form a single enclosure.

* * * * *